US006536417B2

(12) United States Patent
Pearlman et al.

(10) Patent No.: US 6,536,417 B2
(45) Date of Patent: Mar. 25, 2003

(54) EASY FLOW IMPROVED EDGE FILTER AND FUEL SYSTEM

(75) Inventors: Samuel Pearlman, Bloomfield, MI (US); Don H. Santhony, Garden City, MI (US); Michael A. Guerriero, Allen Park, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/742,257

(22) Filed: Dec. 20, 2000

(65) Prior Publication Data

US 2002/0073967 A1 Jun. 20, 2002

(51) Int. Cl.[7] ..... F02M 37/04

(52) U.S. Cl. ..... 123/510; 123/470; 239/590.5; 210/439

(58) Field of Search ..... 123/510, 514, 123/470, 472; 210/439, 446, 459, 437, 438, 511, 447; 239/590.5, 590, 590.3, 601, 533.1, 533.2, 533.3, 533.13

(56) References Cited

U.S. PATENT DOCUMENTS 4,312,479 A 1/1982 Tolan
4,627,574 A * 12/1986 Hofmann ..... 239/590.5
4,790,055 A 12/1988 Raufeisen et al.
4,894,900 A 1/1990 Raufeisen et al.
4,938,193 A 7/1990 Raufeisen et al.
5,515,829 A 5/1996 Wear et al.
5,584,999 A * 12/1996 Cooke ..... 210/439
5,757,259 A 5/1998 Fulford et al.
5,775,303 A * 7/1998 Sweetland et al. ..... 123/470
5,983,863 A * 11/1999 Cavanagh et al. ..... 123/447
5,996,908 A * 12/1999 Hofmann et al. ..... 239/533.3
6,237,570 B1 * 5/2001 Aoki et al. ..... 123/467
6,279,540 B1 * 8/2001 Greaney et al. ..... 123/470

OTHER PUBLICATIONS

Mechanical Drawing from Robert Bosch GmbH dated Feb. 22, 2000.

* cited by examiner

*Primary Examiner*—Carl S. Miller
(74) *Attorney, Agent, or Firm*—Brooks & Kushman P.C.

(57) ABSTRACT

According to the present invention, an edge filter for a pressurized fuel rail system having a plurality of fuel injectors from which pressurized fuel is fed to the injectors through a fuel inlet tube is disclosed. The edge filter has contoured leading and trailing ends that may be either spherical or conical to reduce turbulence in fuel upstream and downstream of the edge filter. The edge filter has inlet and outlet slots that are sloped between about 5% and 15% with the depth of the inlet slot decreasing as it approaches the outlet end and the depth of the outlet slot increasing as it approaches the outlet end.

20 Claims, 3 Drawing Sheets

EASY FLOW IMPROVED EDGE FILTER AND FUEL SYSTEM

BACKGROUND OF THE INVENTION

1. Field of the Invention

The present invention relates to an edge filter for a common rail fuel system and a fuel system incorporating an improved edge filter.

2. Background Art

Common rail fuel systems for high pressure fuel injection in internal combustion engines are used to filter contaminates, impurities and dirt upstream of the fuel injector. Common rail fuel injector systems may operate with pressure in the typical range of 20,000 to 32,000 psi. Injectors are connected to the common rail by high pressure tubing.

Common rail fuel systems utilize electronic controls to control the timing of the beginning of injection and the completion of injection. The timing of the injection cycle may be adjusted electronically. Maintaining high pressure in the system permits the accuracy of fuel injectors to be controlled within microns.

Edge filters are effective to filter particles in the fuel or particles created by machining of components and/or from the high pressure fuel flow. Edge filters are normally provided as the last component prior to the injector. Conventional cylindrical edge filters having flat leading and trailing ends are received in high-pressure connectors having a tapered entry surface in which a cylindrical edge filter is centrally fitted and received.

Prior art edge filters have a generally flat front face with V-shaped openings leading to a V-shaped channel. Fuel flows over the edge of the inlet slot into an outlet slot. The space between the inner diameter of the high-pressure connector and the edge formed between the inlet slot and outlet slot may be on the order of about $25\mu$ to $35\mu$. Three inlet slots and three outlet slots may be provided in a spaced relationship about the edge filter.

Prior art edge filters when operating in the high pressure environment of the edge filter may develop standing pressure waves, stagnation or back flow eddies immediately upstream from the edge filter that are caused by the fuel encountering the planar face of the edge filter. Flow turbulence may also be created downstream of an edge filter that has a planar outlet end surface. Such flow disturbances may create a fuel flow restriction and may create pressure spikes that may adversely affect the life of the injector parts. Pressure spikes may create fatigue and vibration that can reduce the life of the injector parts.

Under ideal conditions pressure spikes are reduced and the flow of fuel through the edge filter should approach laminar flow that reduces fatigue and vibration by minimizing pressure spikes in the fuel injector. Increased pressure capacity and a reduction in disturbances of fluid flow are provided by the invention as summarized below.

SUMMARY OF THE INVENTION

According to the invention a contoured partially conical or partially spherical surface is provided at the leading end and/or trailing end of an edge filter to improve flow through the edge filter by eliminating flow restrictions at the leading end and/or trailing end of the edge filter.

According to the invention, an edge filter for a common rail fuel system is contoured on the inlet end of the edge filter to improve fluid flow upstream of the edge filter. The invention also relates to providing a non-planar surface on the outlet end of the edge filter into which the outlet slots open that is contoured to reduce turbulence in fuel downstream of the outlet end.

According to the invention, a pressurized fuel rail system having a fuel inlet tube defines a receptacle for an edge filter. The edge filter includes a body defining at least one inlet slot open to an inlet end and at least one outlet slot open to an outlet end. An edge is defined by a peripheral surface of the body between the inlet slot and the outlet slot. A filter slot is defined between the inner wall of the receptacle and the edge defined by the peripheral surface of the body. A non-planar surface is formed on the inlet end into which the inlet slot opens. The non-planar surface is contoured to reduce turbulence in fuel upstream of the inlet end.

According to another aspect of the invention, an edge filter having a body as previously described may have a non-planar surface formed on the outlet end into which the outlet slot opens that is contoured to reduce turbulence in fuel downstream of the outlet end.

According to other aspects of the invention, the contoured surface may be at least partially conical or, alternatively, may be at least partially spherical on the leading or trailing ends.

According to another feature of the present invention, the inlet slots and outlet slots preferably are sloped with the inlet slots in the direction of fuel flow being sloped 5% to 10% thereby decreasing the depth of the slot as it approaches the outlet end while the depth of the outlet slot increases at a slope of 5% to 10% as it approaches the outlet end. These slots are preferably V-shaped and are closed at the end opposite their respective faces into which they open. The edge filter of the present invention may have three inlet slots and outlet slots that are spaced apart 120° around the circumference of the edge filter.

According to another aspect of the invention, an edge filter for a pressurized fuel rail system having a plurality of fuel injectors is provided through which pressurized fuel is fed to the injectors through a fuel inlet tube comprising a high pressure connector. The inlet and outlet ends of the edge filter are contoured to form a non-planar surface at both the inlet end and outlet end of the edge filter to reduce turbulence at both the inlet end and outlet end thereof.

These and other aspects of the invention will be better understood in view of the attached drawings and following detailed description of the invention.

DETAILED DESCRIPTION OF THE PREFERRED EMBODIMENT(S)

Figure 1:
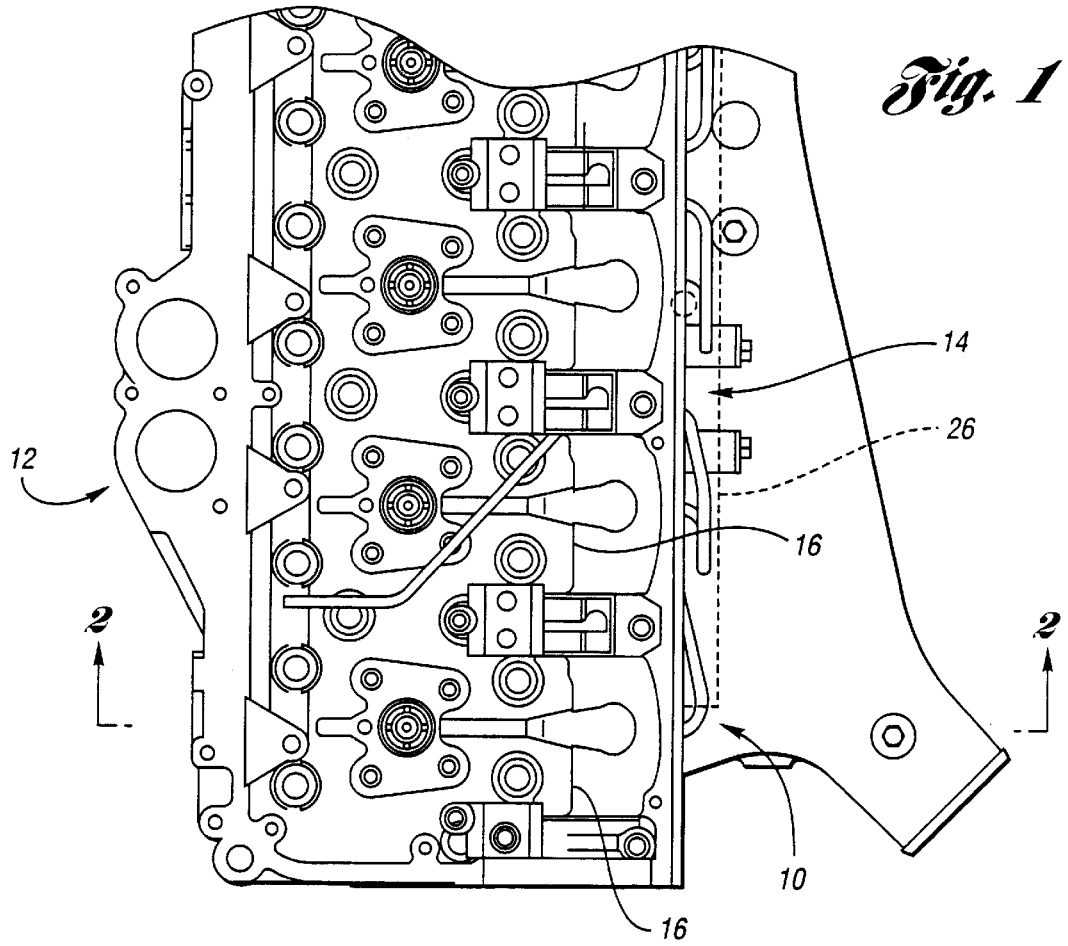
FIG. 1 is a top plan view of a fuel system made in accordance with the invention shown in conjunction with an engine.
Figure 2:
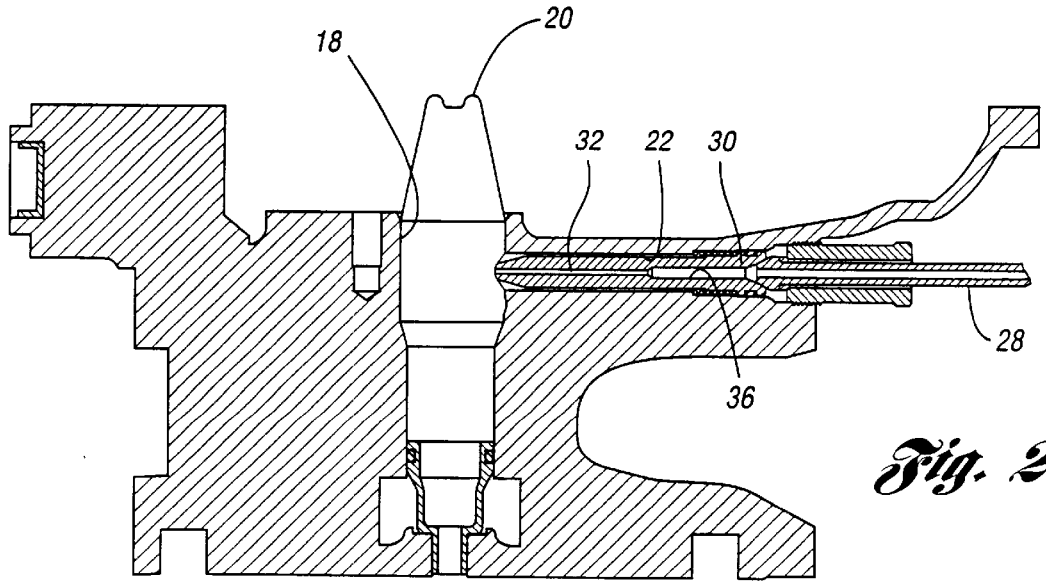
FIG. 2 is a cross-sectional view taken along the line 2—2 in FIG. 1.

Referring now to FIGS. 1 and 2, a fuel system 10 is illustrated that may incorporate the present invention. Fuel system 10 supplies fuel, such as gasoline or diesel fuel, to an engine 12. The engine 12 includes a cylinder head assembly 14 having a plurality of cylinder heads 16. Each cylinder head 16 has an aperture 18 for receiving a fuel injector 20 in a bore 22 formed in the cylinder head 16.

The fuel system 10 utilizes a fuel rail 26 for supplying fuel at relatively high pressure to the engine 12. The fuel system 10 may be used with operating pressures in the range of about 20,000–30,000 pounds per square inch (psi). The fuel system 10 includes a common manifold, or fuel rail, 26 that is connected by high pressure tubing 28 and a high-pressure connector 30 that extend between the common rail 26 and the fuel injectors 20.

The high-pressure connectors 30 have a central bore 32 through which fuel is fed to the fuel injectors 20. A spring 34 urges the connector 30 away from the fuel injector 20. A filter receptacle 36 is aligned coaxial with the central bore 32 and is adapted to receive an edge filter 40 as illustrated in FIGS. 3 through 5.

Figure 3:
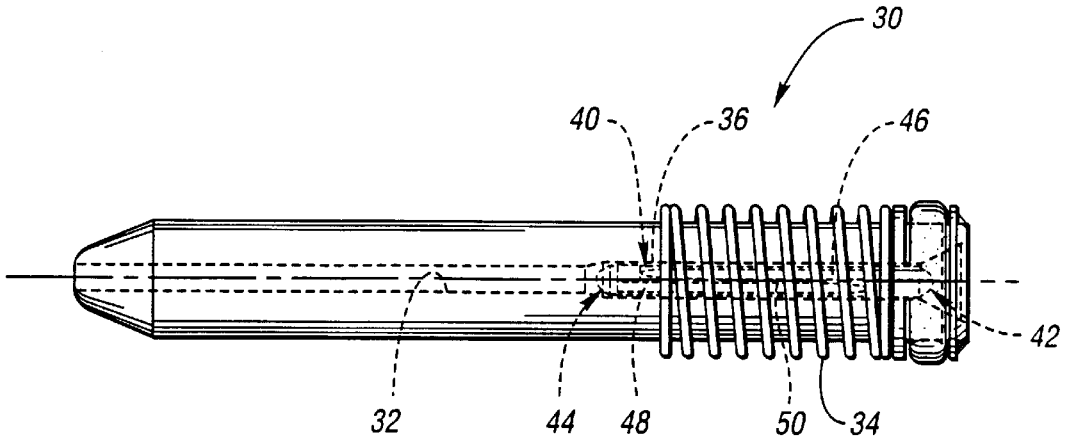
FIG. 3 is a cross-sectional view of a high pressure connector having an edge fuel filter made in accordance with the invention.
Figure 4:
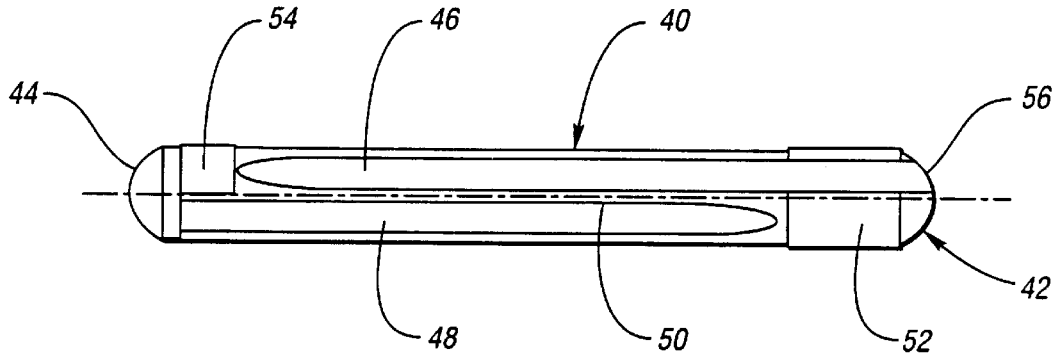
FIG. 4 is an enlarged cross-sectional view showing an edge fuel filter made in accordance with the present invention.

Referring to FIGS. 3 and 4, an edge filter 40 includes a leading end 42 and a trailing end 44 that are contoured to minimize fuel flow restrictions upstream and downstream of the edge filter. By providing convexly contoured surfaces at the leading end and/or trailing end of the edge filter it is believed that fuel flow around the filter will more closely approach laminar flow. As laminar flow is approached, pressure spikes in the fuel flow pressure are reduced that in turn reduces fatigue and vibration and increases the life of injector parts. The edge filter 40 has a V-shaped inlet slot 46 and a V-shaped outlet slot 48. Fuel flows into the V-shaped inlet slot 46 over a filtration edge 50 and into the V-shaped outlet slot 48. Particulates that cannot pass over the filtration edge 50 are trapped in the V-shaped inlet slot 46. The leading end shoulder 52 and trailing end shoulder 54 engage the walls of the edge filter receptacle 36 in a fluid tight relationship. The embodiment shown in FIGS. 3 and 4 features a partially spherical contoured surface 56 that differs from prior art filters that have a flat leading surface and a flat trailing surface that are oriented transversely relative to the central bore 32.

Figure 5:
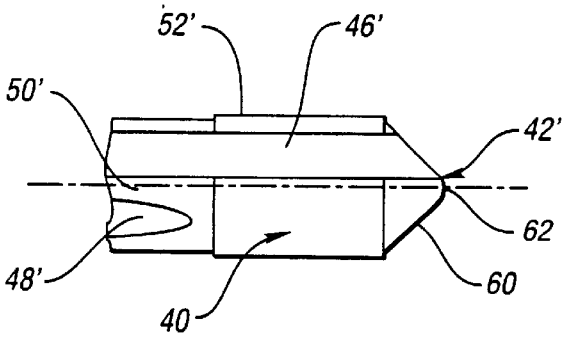
FIG. 5 is an enlarged fragmentary cross-sectional view of the leading end of an edge fuel filter made in accordance with an alternative embodiment of the present invention.

Referring now to FIG. 5, an alternative embodiment of the invention is shown wherein the edge filter 40' has a leading end 42' that is contoured to provide a conical contoured surface 60 having a radiused end point 61. Fuel flowing into the V-shaped inlet slot 46' flows through the filter 40' to the V-shaped outlet slot 48' over the filtration edge 50'. The edge filter 40' is held within the high pressure connector 30' with the leading end shoulder 52' being received in a fluid-type relationship in the filter receptacle 36'. The conical contoured surface 60 shown in FIG. 5 and the spherical contoured surface 56 shown in FIGS. 3 and 4 angularly redirect fuel flow instead of directly impinging upon a flat inlet end surface.

It should be noted that while only one V-shaped inlet slot 46 and one V-shaped outlet slot 48 are shown, it is preferable to provide three V-shaped inlet slots and three V-shaped outlet slots that are equally spaced about the cylindrical perimeter of the edge filter 40. It is also possible to provide a different number of pairs of V-shaped slots.

Figure 6:
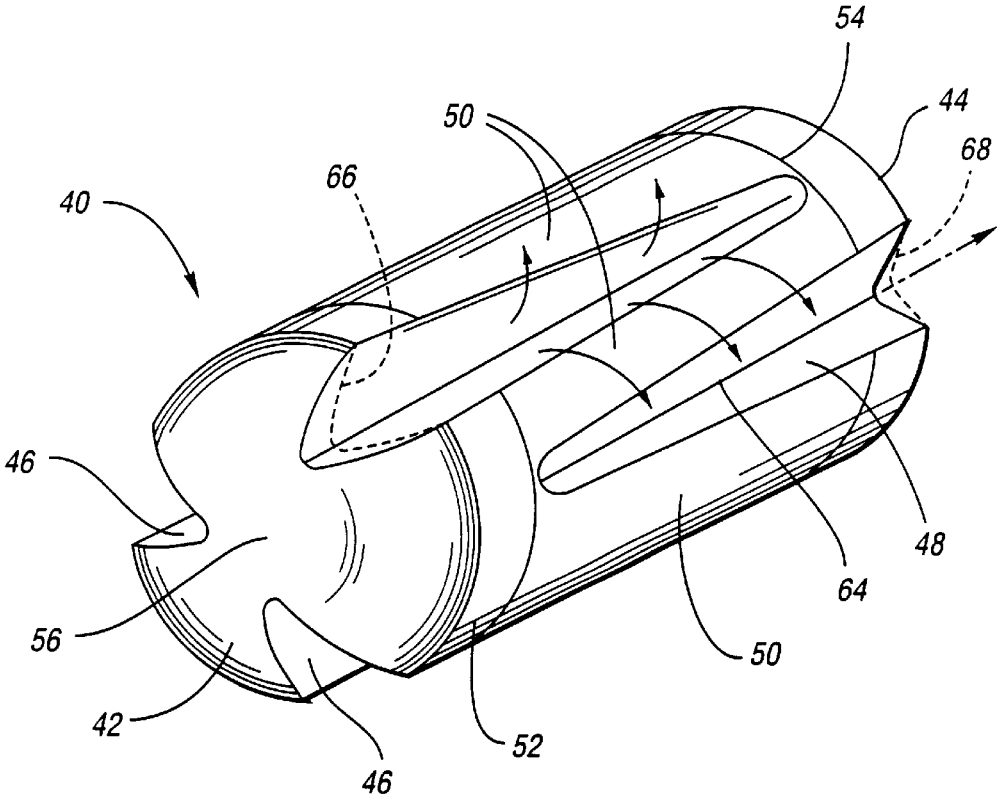
FIG. 6 is a perspective view of an edge fuel filter made in accordance with the present invention.
Figure 7:
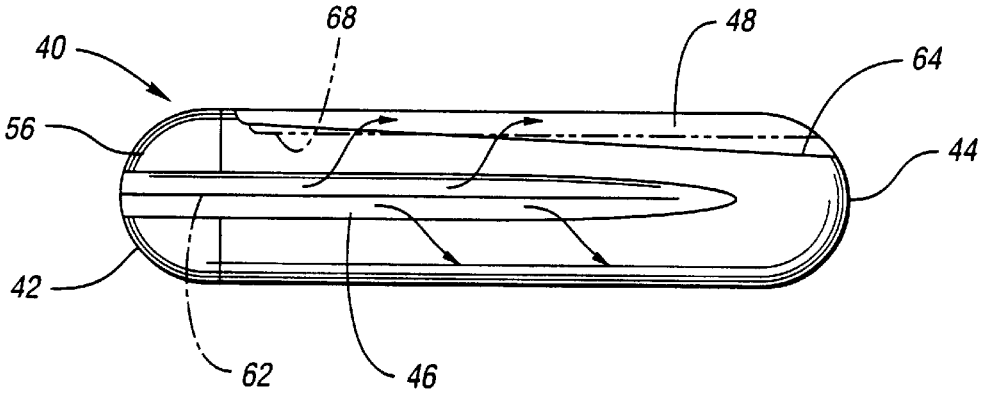
FIG. 7 is a schematic side elevation view of an edge fuel filter made in accordance with the present invention.

Referring now to FIGS. 6 and 7, the structure of the edge filter 40 is shown to illustrate the concept of providing a sloped inlet V-shape slot 46 and a sloped outlet V-shaped slot 48. The edge filter 40 has a leading end 42 and a trailing end 44. Fuel flowing through the edge filter 40 enters through the inlet V-shaped slot 46 and flows over one of the filtration edges 50 and into the outlet V-shape slot 48. The base 62 of the inlet slot 46 is sloped preferably between 5% and 15% beginning with a maximum depth at the inlet end 42 and a reduced depth as the inlet slot 46 approaches the trailing end 44. The base 64 of the outlet slot 48 increases in depth with a slope of preferably between 5% and 15% as it approaches the trailing end 44.

As shown in FIG. 6, a phantom line 66 illustrates the depth of prior art base inlet slots that normally have a base that is not sloped, that is, it has the same depth substantially throughout the length of the slot. The dash line 68 illustrates where the prior base of the V-shaped outlet slot 46 would be and it likewise has a consistent depth substantially throughout its length.

Referring to FIG. 7, the slope of the slots is illustrated with reference to the outlet slot. The base 64 is shown to be of increasing depth as it approaches the trailing end 44. A non-sloped V-shaped outlet slot is indicated in FIG. 7 by a phantom line identified by reference numeral 68.

While several embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An edge filter for a fuel injector having a fuel inlet tube defining a receptacle for the edge filter comprising:

a body defining at least one inlet slot open to a leading end of the edge filter, at least one outlet slot open to a trailing end, and an edge defined by a peripheral surface of the body between the inlet slot and the outlet slot, a filter slot being defined between an inner wall of the receptacle and the edge; and a non-planar surface formed on the leading end into which the inlet slot opens that is contoured to reduce turbulence in fuel flow upstream of the leading end.

2. The edge filter of claim 1 wherein the non-planar surface is at least partially conical.

3. The edge filter of claim 1 wherein the non-planar surface is at least partially spherical.

4. The edge filter of claim 1 wherein a second non-planar surface is provided on the trailing end of the edge filter.

5. The edge filter of claim 4 wherein the second non-planar surface is at least partially conical.

6. The edge filter of claim 4 wherein the second non-planar surface is at least partially spherical.

7. An edge filter for a fuel injector having a fuel inlet tube defining a receptacle for the edge filter comprising:

a body defining at least one inlet slot open to a leading end of the edge filter, at least one outlet slot open to a trailing end, and an edge defined by a peripheral surface of the body between the inlet slot and the outlet slot, a filter slot being defined between an inner wall of the receptacle and the edge;

wherein the depth of the outlet slot increases as it approaches the outlet end; and means for reducing turbulence in fuel flow upstream of the leading end of the edge filter.

8. An edge filter for a fuel injector having a fuel inlet tube defining a receptacle for the edge filter comprising:

a body defining at least one inlet slot open to a leading end of the edge filter, at least one outlet slot open to a trailing end, and an edge defined by a peripheral surface of the body between the inlet slot and the outlet slot, a filter slot being defined between an inner wall of the receptacle and the edge;

wherein the depth of the inlet slot decreases as it approaches the outlet end; and means for reducing turbulence in fuel flow upstream of the leading end of the edge filter.

9. An edge filter for a fuel injector having a fuel inlet tube defining a receptacle for the edge filter comprising:

a body defining at least one inlet slot open to a leading end of the edge filter, at least one outlet slot open to a trailing end, and an edge defined by a peripheral surface of the body between the inlet slot and the outlet slot, a filter slot being defined between an inner wall of the receptacle and the edge;

wherein the depth of the outlet slot increases as it approaches the outlet end and the depth of the inlet slot decreases as it approaches the outlet end; and means for reducing turbulence in fuel flow upstream of the leading end of the edge filter.

10. The edge filter of claim 9 wherein the depth of the inlet and outlet slots change with a slope of about 5% to 15%.

11. The edge filter of claim 9 wherein three V-shaped inlet slots and three V-shaped outlet slots are provided at equally spaced radial locations on the edge filter.

12. An edge filter for a fuel injector having a high pressure connector defining a receptacle for the edge filter comprising:

a body defining at least one inlet slot open to a leading end of the edge filter, at least one outlet slot open to a trailing end of the edge filter, a filter slot defined between an inner wall defined by the receptacle and the edge;

a non-planar surface formed on the leading end into which the inlet slot opens that is contoured to reduce turbulence in fuel flow upstream of the leading end; and a non-planar surface formed on the outlet end into which the outlet slot opens that is contoured to reduce turbulence in fuel downstream of the trailing end.

13. The edge filter of claim 12 wherein the non-planar surface is at least partially conical.

14. The edge filter of claim 12 wherein the non-planar surface is at least partially spherical.

15. A pressurized fuel rail system having a plurality of fuel injectors through which pressurized fuel is fed to the injectors through a high-pressure tubing and a high-pressure connector, comprising:

an edge filter for a fuel injector having a receptacle defined by the high-pressure connector;

the edge filter defining at least one inlet slot open to a leading end, at least one outlet slot open to a trailing end, and an edge defined by a peripheral surface of the edge filter between the inlet slot and the outlet slot, a filter slot defined between an inner wall of the receptacle and the edge;

a first non-planar surface formed on the leading end into which the inlet slot opens that is contoured to reduce turbulence in fuel upstream of the leading end; and a second non-planar surface formed on the trailing end into which the outlet slot opens that is contoured to reduce turbulence in fuel downstream of the trailing end.

16. The pressurized fuel rail system of claim 15 wherein the first and second non-planar surfaces are at least partially conical.

17. The pressurized fuel rail system of claim 16 wherein the first and second non-planar surfaces are at least partially spherical.

18. The pressurized fuel rail system of claim 15 wherein the depth of the outlet slot increases as it approaches the outlet end and the depth of the inlet slot decreases as it approaches the outlet end.

19. The edge filter of claim 18 wherein the depth of the inlet and outlet slots change with a slope of 5% to 15%.

20. The pressurized fuel rail system of claim 15 wherein three V-shaped inlet slots and three V-shaped outlet slots are provided at equally spaced radial locations on the edge filter.

* * * * *

UNITED STATES PATENT AND TRADEMARK OFFICE

CERTIFICATE OF CORRECTION

PATENT NO. : 6,536,417 B2 
DATED : March 25, 2003
INVENTOR(S) : Samuel Pearlman, Dan H. Santhony and Michael A. Guerriero It is certified that error appears in the above-identified patent and that said Letters Patent is hereby corrected as shown below:

Title page,
Item [75], Inventors, "Don H. Santhony" should read -- Dan H. Santhony --.

Signed and Sealed this

First Day of July, 2003

JAMES E. ROGAN
*Director of the United States Patent and Trademark Office*